US005704564A

United States Patent [19]

Neiderman

[11] Patent Number: 5,704,564

[45] Date of Patent: Jan. 6, 1998

[54] APPARATUS FOR PRODUCING A PLURALITY OF IDENTICAL LENGTHS OF RIBBON

[76] Inventor: Bret J. Neiderman, 29709 Quail Run Dr., Agoura Hills, Calif. 91301

[21] Appl. No.: 645,205

[22] Filed: May 13, 1996

[51] Int. Cl.[6] ..... B65H 35/04

[52] U.S. Cl. ..... 242/527.5; 242/530.1; 242/537; 242/546.1; 242/577

[58] Field of Search ..... 242/527.5, 527.7, 242/598.3, 599.1, 530.1, 538, 540, 546.1, 537, 577

[56] References Cited

U.S. PATENT DOCUMENTS

| | | | |
|---|---|---|---|
| 298,670 | 5/1884 | Crosby . | |
| 331,803 | 12/1885 | Lumsden . | |
| 538,245 | 4/1895 | Fairbanks . | |
| 538,464 | 4/1895 | Palmer et al. . | |
| 844,739 | 2/1907 | Nance | 242/537 X |
| 856,289 | 6/1907 | Parrish | 242/537 X |
| 948,207 | 2/1910 | Coon | 242/537 X |
| 1,260,786 | 3/1918 | Manz . | |
| 1,271,736 | 7/1918 | Loewenstine | 242/546.1 X |
| 1,310,741 | 7/1919 | Cook | 242/577 |
| 1,597,679 | 8/1926 | Forte | 242/598.3 X |
| 1,950,492 | 3/1934 | Holmes, Jr. | 242/575.3 |
| 1,963,644 | 6/1934 | Bronander | 164/42 |
| 2,073,420 | 3/1937 | Johnston . | |
| 2,105,707 | 1/1938 | Stancliff . | |
| 2,650,037 | 8/1953 | Judelson | 242/537 X |
| 2,703,612 | 3/1955 | Nye et al. | 164/42 |
| 3,026,060 | 3/1962 | Norehad . | |
| 3,280,539 | 10/1966 | Parrott | 242/599.1 X |
| 3,467,332 | 9/1969 | Bachman . | |
| 3,815,842 | 6/1974 | Scrogin | 242/577 X |
| 3,836,059 | 9/1974 | Lauen et al. | 242/125.2 X |
| 4,174,076 | 11/1979 | Tolliver . | |
| 4,201,351 | 5/1980 | Tolliver . | |
| 4,314,678 | 2/1982 | Upchurch | 242/599.1 |
| 5,025,999 | 6/1991 | Littrell | 242/577 |

FOREIGN PATENT DOCUMENTS

| | | | |
|---|---|---|---|
| 1073781 | 6/1967 | United Kingdom | 242/537 |

*Primary Examiner*—Daniel P. Stodola
*Assistant Examiner*—William A. Rivera
*Attorney, Agent, or Firm*—Jack C. Munro

[57] ABSTRACT

An apparatus for cutting ribbon which utilizes a reel that is mounted on a frame. The reel is to be manually rotated with a length of ribbon to be wound on the peripheral surface of the reel which comprises a plurality of elongated arms. One revolution of the reel to be completed for a single length of ribbon. Upon the desired number of revolutions of the reel, the ribbon is then to be cut in a direction along the length of the reel which will result in a producing of a plurality of identical lengths of ribbon. The peripheral surface of the reel is adjustable radially relative to the rotating center shaft of the reel.

6 Claims, 2 Drawing Sheets

APPARATUS FOR PRODUCING A PLURALITY OF IDENTICAL LENGTHS OF RIBBON

BACKGROUND OF THE INVENTION

1) Field of the Invention

The field of this invention relates to an apparatus for producing a plurality of identical lengths of ribbon.

2) Description of the Prior Art

Ribbon is commonly supplied on reels. In the manufacture of certain products, it is necessary to utilize a length of ribbon. An example of such a product would be a balloon. When the balloon is inflated, it is desirable to connect a streamer to the balloon. Parties are given where there may be utilized hundreds of balloons with each balloon being connected to a separate streamer. A typical streamer length is three feet but may be only two feet, or could be as long as six feet.

It is common for individuals in the party business to individually cut the lengths of ribbon that are necessary to make the streamers. This is exceedingly time consuming. The lengths of ribbon are extracted from a spool which generally contains five hundred or one thousand feet of ribbon. There is a need to construct an apparatus where a plurality of equal length streamers can be easily and quickly obtained.

In the past, there have been attempts at constructing such an apparatus that is usable in conjunction with sheets of plastic or paper. However, the apparatuses in the past have been designed to be rather complex in construction therefore inherently expensive to manufacture and sell to the consumer. To the applicant's knowledge, there is not available a relatively inexpensive piece of equipment that could be purchased by a typical party store to obtain ribbon streamers to be attached to balloons.

SUMMARY OF THE INVENTION

The ribbon cutter apparatus of the present invention utilizes a frame on which is mounted a reel assembly. The reel assembly constitutes a pair of end discs that are located in a spaced apart manner and connected together by a center rotating shaft. The shaft is to be rotated manually but it is certainly within the scope of this invention that the shaft could be rotated electrically. Interconnected between the end discs are arms, with generally at least four in number of such arms being employed. The arms are located parallel to the shaft and are spaced therefrom. Radial spacing of the arms from the shaft can be varied by mounting of an end of each arm within a bar with this bar being radially movable within its respective end disc. Also included within the bar are a plurality of holes. Mounting the arms in different holes alters its distance from the center rotating shaft. The ribbon that is to be cut is to be wound about the arms, and the closer the arms are to the center rotating shaft, the shorter in length the pieces of ribbon that will be obtained. The farther the arms are away from the rotating shaft, the greater in length of the pieces of ribbon that are obtained. The ribbon supply reel is also mounted on the frame and is rotated during the time that the ribbon is wound about the arms.

The primary objective of the present invention is to provide a ribbon cutter which facilitates the obtaining of a mass of equal length of ribbons with the cutter being small in size and relatively inexpensive to the consumer.

Another objective of the present invention is to obtain a ribbon cutter which can be quickly and easily adjusted so as to obtain any desirable length of ribbon within a wide range of lengths.

Another objective of the present invention is to provide a ribbon cutter which can be adjusted easily and with a minimum amount of skill in order to obtain any desirable length of ribbon.

Another objective of the present invention is to construct the ribbon cutter to be of sufficiently small size and weight facilitating portability to different sites for production.

DETAILED DESCRIPTION OF THE PREFERRED EMBODIMENT

Figure 1:
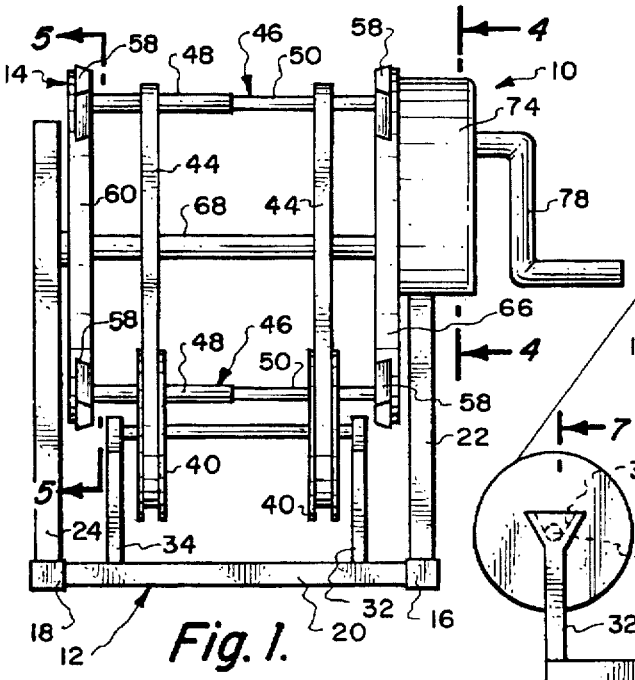
FIG. 1 is a front elevational view of the ribbon cutter of the present invention.
Figure 2:
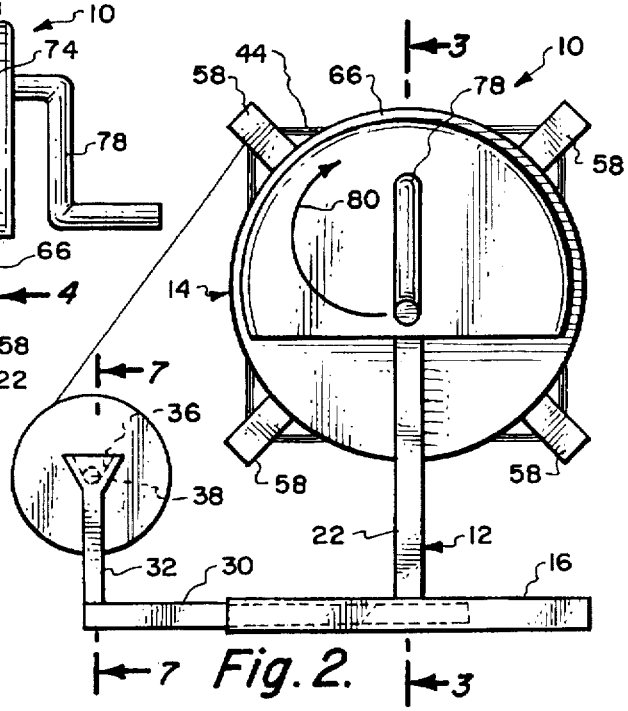
FIG. 2 is a right side view of the ribbon cutter of the present invention.
Figure 3:
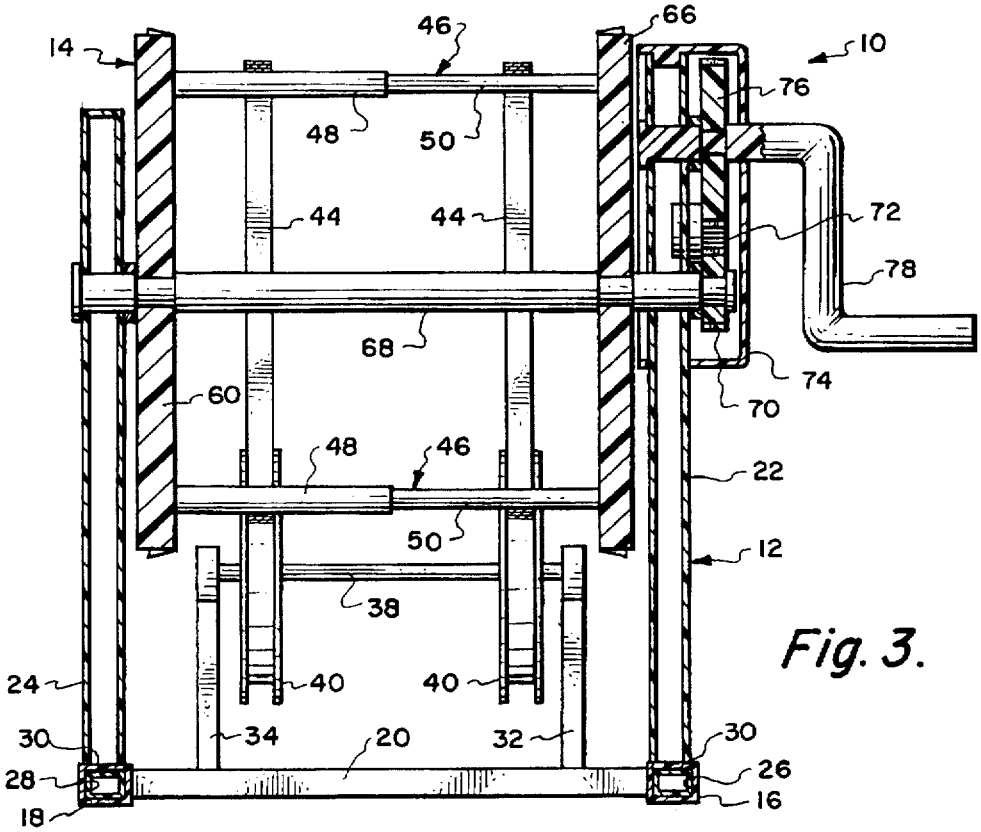
FIG. 3 is a cross-sectional view of the ribbon cutter of the present invention taken along line 3—3 of FIG. 2.
Figure 4:
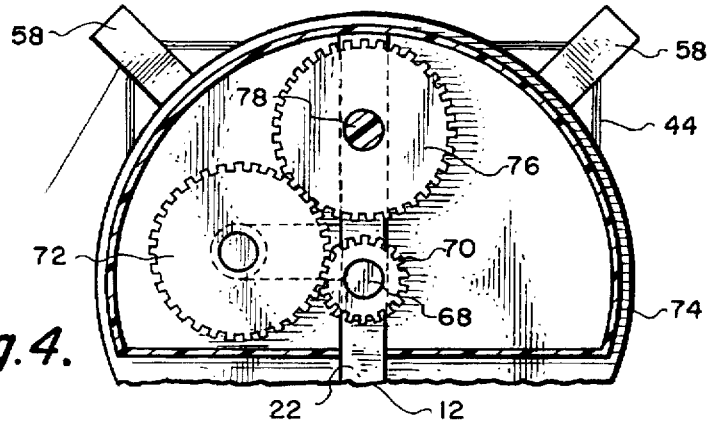
FIG. 4 is a cross-sectional view taken along line 4—4 of FIG. 1 showing the gear arrangement utilized in conjunction with the operating handle and the rotating shaft of the ribbon cutter of the present invention.
Figure 5:
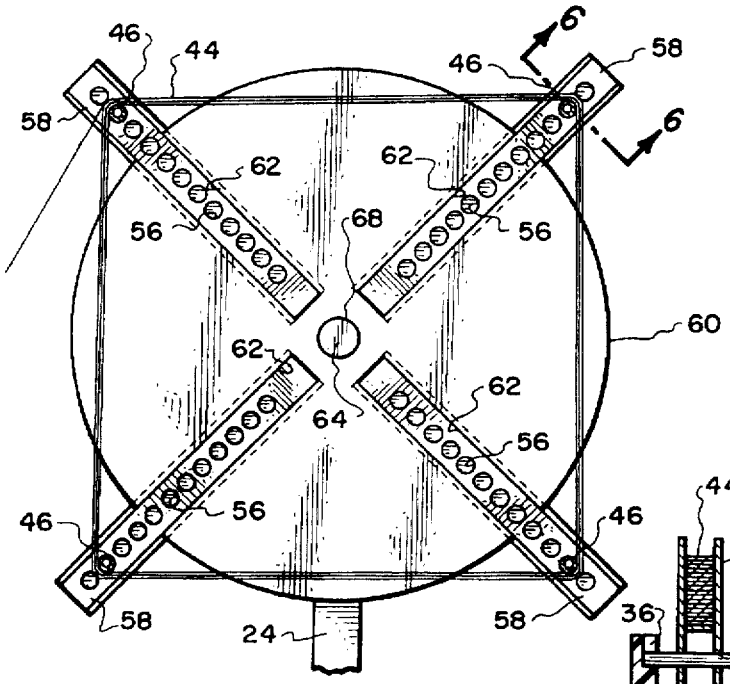
FIG. 5 is a cross-sectional view taken along line 5—5 of FIG. 1 showing in detail the inside surface of one of the end discs utilized in conjunction with the ribbon cutter of the present invention.
Figure 7:
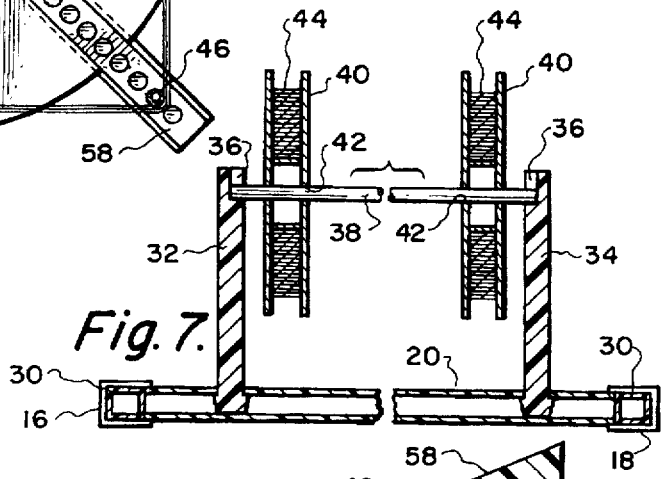
FIG. 7 is a cross-sectional view through the supply stand that is utilized in conjunction with the supply reel of ribbon of the ribbon cutter of the present invention.
Figure 6:
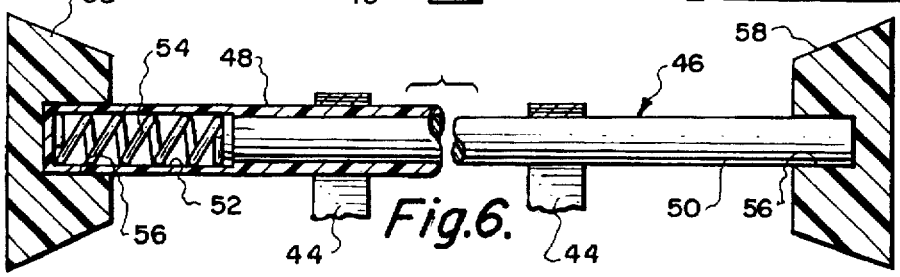
FIG. 6 is a cross-sectional view taken along line 6—6 of FIG. 5.

Referring particularly to the drawings, there is shown the ribbon cutter 10 of this invention. The ribbon cutter 10 includes a tubular frame 12 and a reel 14. The tubular frame 12 is formed of a pair of elongated members 16 and 18 which are located parallel to each other and spaced apart. Typical material of construction for the frame 12 would normally be steel, aluminum or plastic. Fixedly interconnecting with the members 16 and 18 is a cross member 20. Fixedly connected to the member 16 and extending upwardly therefrom is a support post 22. A similar support post 24 is fixedly connected to the member 18 and extending upwardly therefrom. The support posts 22 and 24 are connected substantially perpendicular to their respective members 16 and 18.

The members 16 and 18 are open providing interior chambers 26 and 28 respectively. A U-shaped member 30, which has a pair of depending legs, is to connect with the elongated members 16 and 18 so that a leg of the U-shaped member 30 is located within interior chamber 26 and the other leg of the U-shaped member 30 is located within the interior chamber 28. The U-shaped member 30 is to be adjustably slidable relative to the elongated members 16 and 18.

Fixedly mounted on the U-shaped member 30 and extending upwardly therefrom are short posts 32 and 34. Each short post 32 and 34 has a V-shaped slot 36 at its upper end. The V-shaped slots 36 face each other. A rod 38 is to be mountable in conjunction with the slots 36 with each end of the rod 38 connecting with a slot 36. A ribbon supply reel 40 is to be mounted on the rod 38 and is to be freely rotatable on the rod 38. It is to be known that the drawings show that there are two in number of the supply reels 40 mounted on the rod 38. However, in actual practice there may be only one such supply reel 40 mounted on the rod 38 or there may be-more than two in number of the supply reels 40 mounted on the rod 38. It is to be understood that the rod 38 is to be disengaged from the V-shaped slots 36 with the rod 38 then passed through the center hole 42 of the supply reels 40 which will then rotatingly mount the supply reels 40 on the rod 38. If the supply reel 40 has a large diameter, the U-shaped member 30 is to be slid outward away from the reel 14 to provide adequate spacing so supply reel 40 will rotate freely and not contact reel 14.

Wound on each supply reel 40 is a quantity of ribbon 44. The ribbon 44 is to be unwindable from the supply reel 40. The free end of the ribbon 44 of supply reel 40 is attached, as with adhesive tape, onto an arm 46. It is to be noted that there are four in number of the arms 46. It is to be understood that there may be fewer arms 46 or there could be a greater number of the arms 46. The arms 46 are part of the reel 14. It doesn't make any difference to which arm 46 the ends of the ribbon 44 are attached, it just means that the ends of the ribbon 44 are to be attached to one of the arms 46. Each of the arms 46 are elongated and are composed of an outer tube 48 and an inner tube 50. The inner tube 50 is telescopingly received within the outer tube 48. Contained within the internal chamber 52 of the outer tube 48 is a coil spring 54. The inner tube 50 is to abut against the coil spring 54. The normal at-rest position for each of the arms 46 is as shown in the drawings. However, the inner tube 50 can be pushed against the coil spring 54 and compressed such that it will shorten the length of the arm 46. This will permit the ends of the arm 46 to be disengaged from the mounting holes 56 formed within a bar 58. There are eight in number of the bars 58, all of which are identical. Each of the bars 58 include eleven in number of holes 56. Each of the bars 58 is basically in the shape of a trapezoid in transverse cross-section. Four in number of the bars 58 are mountable within an end disc 60. Each bar 58 is slidable within its own dovetail slot 62 formed within the end disc 60. There are four in number of the dovetail slots 62 formed within the end disc 60. Each dovetail slot 62 is radially located relative to the center 64 of the end disc 60. The dovetail slots 62 are evenly spaced apart. It is to be understood that there are also four in number of the bars 58 similarly mounted within the end disc 66. The end discs 60 and 66 are fixedly connected together by a shaft 68. The longitudinal center axis of the shaft 68 is in alignment with the center 64 and also the center (not shown) of the end disc 66.

It is to be understood that an end of an arm 46 is to be engaged with one hole 56 of a bar 58 mounted on the end disc 60. The opposite end of the arm 46 is then engaged with a hole mounted within a bar 58 mounted within the end disc 66. The two bars 58 of the end discs 60 and 66 are in alignment with each other. Also, the holes 56 of the two bars 58 are in alignment. The result is each arm 46 is mounted substantially parallel to the shaft 68. Insertion of each arm 46 in conjunction with the holes 56 is accomplished by moving of the inner tube 50 within the outer tube 48 compressing the spring 54 until the length of the arm 46 is sufficiently shortened so as to be permit location of the arm directly aligned between the holes 56. Once this occurs, upon release of the arm 46, the spring 54 will automatically move the arm 46 in an outward direction keeping it snug within its respective holes 56.

It is to be understood that the arms 46 could engage with any of the holes 56 along the length of each bar 58. If the arms 46 were mounted within the holes 56 that are located nearest the shaft 68, then when the ribbon 44 is attached to one of the arms 48 and the reel 14 rotated, the ribbon 44 will be wound about the arms 46. Because the arms 46 are located as close as possible to the shaft 68, a single revolution of the ribbon 44 about the arms 46 will be the shortest in length. Normally this length will be no more than a foot to a foot and a half. As the arms 46 are mounted within different holes 56 that get further from the shaft 68, the length of the ribbons that will be produced will be greater. Each of the bars 58 are capable of being slid within their respective dovetail slot 62 and moved radially outward on their respective discs 60 and 66. With the arms 46 mountable within the holes 56 that are located furthest from the shaft 68, it is to be understood that the ribbons produced will be the longest in length. Typically, the length produced will be in the range of six feet.

The shaft 68 is rotatably mounted between the support posts 22 and 24. The shaft 68 can be adjusted relative to cross member 20 by the support posts 22 and 24 being adjustable which is not shown in the drawings. Directly adjacent the support posts 22 and 24, and fixedly mounted on the shaft 68, is a driven gear 70. This driven gear 70 is in engagement with an idler gear 72. The idler gear 72 is rotatably mounted on a gear housing 74 which is fixedly mounted to the support post 22. A drive gear 76 is also rotatably mounted on the housing 74. A handle 78 is rotatably mounted to the support posts 22 with the handle 78 passing through the gear housing 74. The rotation of the handle 78 is depicted by means of arrow 80. Fixedly mounted on the handle 78 is the drive gear 76. It can thus be seen that manual rotation of the handle 78 will result in rotation of gears 76, 72 and 70 with rotation of gear 70 being in the same direction as gear 76. By varying the sizes of gears 70 and 76, a different rotational ratio can be obtained between the handle 78 and the reel 14. In the embodiment shown within the drawings, a single rotation of the handle 78 will result in about five rotations of the reel 14. The reason for this is that let's assume the user needs five hundred ribbon streamers. The user attaches the ends of the ribbons 44 to one of the bars 46. The user then only needs to turn the handle 78 one hundred times, which in turn will result in the ribbon 44 being around about the bars 46 five hundred times. The user then takes a knife or scissors and cuts across the ribbons 44 in the direction parallel to the shaft 68. This will result in the production of the five hundred ribbon streamers. These ribbon streamers will all be the same length. These ribbon streamers will normally be used in conjunction with a party with typically each streamer being attached to a balloon.

Normally, each of the bars 58 will be mounted in a slidably snug manner with their respective dovetail slot 62. However, it may be desirable to mount in conjunction with each bar 58 a locking device to securely lock into position the bar 58 at various positions relative to its respective end disc 60 or 66.

What is claimed is:

1. An apparatus for producing a plurality of identical strips of ribbon comprising:

a frame;

a reel assembly mounted on said frame, said reel assembly having a pair of end discs which are fixedly mounted in a spaced-apart manner on a shaft, each said end disc having a peripheral edge, said shaft being rotatable;

a plurality of dovetail slots formed within each said end disc, said dovetail slots of each said end disc being radially located relative to said shaft, said dovetail slots being spaced from said shaft;

a bar being slidably mounted within each said dovetail slot with there being a separate said bar for each said dovetail slot resulting in a plurality of said bars, each said bar being independently adjustable by being movable relative to its respective said dovetail slot in a radial direction relative to said shaft, each said bar being snugly retained within its respective said dovetail slot and when a said bar is manually grabbed and moved and then released, the said bar will remain in its established position;

each said bar including a series of holes located in a line arrangement radially aligned relative to said shaft, an elongated arm lockingly engaging one of said holes, there being a plurality of said elongated arms with each said elongated arm being located parallel to said shaft, each said elongated arm being removably mounted between a pair of said bars, each said elongated arm being adjustably movable between aligned pairs of said holes of its respective pair of said bars to cause said elongated arm to be located nearer to or farther away from said shaft, a portion of each said bar extending beyond said peripheral edge of its respective said end disc; and whereby an elongated length of ribbon is to be wound about said elongated arm by rotating said reel assembly and then by manual cutting with a separate cutting implement across the wound ribbon in a direction parallel to said elongated arms results in the producing of a plurality of individual said strips of ribbon all of the same length, whereby remounting of said elongated arms in said holes that are further from said shaft will result in the production of a longer length of said strips of ribbon, whereby adjusting of the position of said bars by slidably moving of said bars to a radially outward position will also result in the production of a longer length of said strips of ribbon.

2. The apparatus as defined in claim 1 wherein:

said dovetail slots of each said end disc being evenly spaced apart.

3. The apparatus as defined in claim 1 wherein:

said end discs being of the same diameter.

4. The apparatus as defined in claim 1 wherein:

each said elongated arm comprising a pair of telescoping tubes which are biased by a spring to an extended at-rest position.

5. The apparatus as defined in claim 1 wherein:

said bars being identical.

6. The apparatus as defined in claim 1 wherein:

said dovetail slots of each said end disc being evenly spaced apart, said end discs being of the same diameter, each said elongated arm comprising a pair of telescoping tubes which are biased by a spring to an extended at-rest position, said bars being identical.

* * * * *